US005611664A

United States Patent [19]

Haugen

[11] Patent Number: 5,611,664

[45] Date of Patent: Mar. 18, 1997

[54] APPARATUS TO ACHIEVE PASSIVE DAMPING OF FLOW DISTURBANCES IN A CENTRIFUGAL COMPRESSOR TO CONTROL COMPRESSOR SURGE

[75] Inventor: Ronald L. Haugen, Mayfield, Ky.

[73] Assignee: Ingersoll-Rand Company, Woodcliff Lake, N.J.

[21] Appl. No.: 453,545

[22] Filed: May 30, 1995

Related U.S. Application Data

[62] Division of Ser. No. 238,994, May 6, 1994.

[51] Int. Cl.[6] ..... F04D 27/00

[52] U.S. Cl. ..... 415/146; 415/147; 137/514; 251/64

[58] Field of Search ..... 137/514, 527; 251/48, 54, 64; 415/119, 146, 147

[56] References Cited

U.S. PATENT DOCUMENTS

| | | | |
|---|---|---|---|
| 1,846,483 | 2/1932 | Gilbert . | |
| 2,198,021 | 4/1940 | Wood . | |
| 2,316,278 | 4/1943 | Orshansky, Jr. . | |
| 3,047,012 | 7/1962 | Smith | 137/514 |
| 3,174,352 | 3/1965 | Jekat | 415/147 |
| 3,487,855 | 1/1970 | Lautenberger, Jr. . | |
| 3,672,786 | 6/1972 | Mount | 415/147 |
| 4,177,649 | 12/1979 | Venema . | |
| 4,286,621 | 9/1981 | Glahn | 137/514 |
| 4,309,871 | 1/1982 | Venema . | |
| 4,330,006 | 5/1982 | Eck et al. | 137/514 |
| 4,449,358 | 5/1984 | Mani . | |
| 4,464,720 | 8/1984 | Agarwal . | |
| 4,504,188 | 3/1985 | Traver et al. . | |
| 4,586,870 | 5/1986 | Hohlweg et al. . | |
| 4,646,530 | 3/1987 | Huenniger . | |
| 4,686,834 | 8/1987 | Haley et al. . | |
| 4,721,281 | 1/1988 | Kratt et al. | 251/54 |
| 4,867,199 | 9/1989 | Marx | 137/514 |
| 4,930,539 | 6/1990 | Van Rooy | 251/64 |
| 5,048,553 | 9/1991 | Vandevyvere . | |
| 5,074,752 | 12/1991 | Murphy et al. . | |
| 5,143,514 | 9/1992 | Adachi . | |
| 5,160,248 | 11/1992 | Clarke . | |
| 5,173,020 | 12/1992 | Ebbing et al. . | |
| 5,199,856 | 4/1993 | Epstein et al. . | |
| 5,215,432 | 6/1993 | Pickering et al. . | |
| 5,242,263 | 9/1993 | Mondoloni . | |
| 5,257,902 | 11/1993 | Atarashi et al. . | |
| 5,311,898 | 5/1994 | Taylor | 251/48 |

FOREIGN PATENT DOCUMENTS

| | | | |
|---|---|---|---|
| 0126399 | 6/1986 | Japan | 415/146 |
| 0776631 | 6/1957 | United Kingdom | 415/146 |
| 891635 | 3/1962 | United Kingdom . | |

OTHER PUBLICATIONS

Dynamic Control of Centrifugal Compressor Surge Using Tailored Structures, by:D. Gysling, J. Dugundju, E. Greitzer and A. Epstein Transactions of the ASME 710/vol. 113, Oct. 1991.

Active Stabilization of Centrifugal Compressor Surge by: J. Pinsley, G. Guenette, A. Epstein, E. Greitzer Transaction of the ASME 724/vol. 113, Oct. 1991.

*Primary Examiner*—Edward K. Look
*Assistant Examiner*—Mark Sgantzos
*Attorney, Agent, or Firm*—Michael M. Gnibus

[57] ABSTRACT

An apparatus achieves passive damping of flow disturbances to control centrifugal compressor surge. The apparatus includes a centrifugal compressor for compressing a low pressure fluid. The centrifugal compressor has an impeller, an inlet which communicates with an atmosphere and a discharge through which compressed air is supplied to a compressed air system. A fluid flow control is flow connected with the inlet for controlling the flow of a low pressure fluid to the compressor. A check valve is flow connected with the discharge for preventing high pressure fluid from back flowing to the compressor. A vane diffuser assembly fluidly communicates with the impeller. A spring-mass-damper system is coupled to any one or all of the fluid flow control, check valve or vane diffuser to dampen low amplitude flow disturbances of the compressible fluid.

2 Claims, 4 Drawing Sheets

APPARATUS TO ACHIEVE PASSIVE DAMPING OF FLOW DISTURBANCES IN A CENTRIFUGAL COMPRESSOR TO CONTROL COMPRESSOR SURGE

This is a divisional of application Ser. No. 08/238,994 filed May 6, 1994.

BACKGROUND OF THE INVENTION

This invention generally relates to centrifugal compressors, and more particularly to an apparatus for achieving passive damping of flow disturbances in a centrifugal compressor to control compressor surge.

The operating range of turbomachinery compression systems, such as centrifugal compressors, is very often limited by the onset of fluid dynamic instabilities such as choke and surge. Choke is determined by sonic velocity (Mach Number) limits. Surge is a self-excited instability, evidenced by large amplitude oscillations of annulus-averaged mass flow and plenum pressure rise. Surge can cause reduced performance and efficiency of the turbomachine, and, in some cases, failure due to the large unsteady aerodynamic force on the various turbomachinery components.

To avoid surge, the compression system is generally operated away from the "surge line" which is the boundary between stable and unstable compression system operation, and which is graphically portrayed in FIG. 1. It is known that operating the compressor at some distance from this surge line, on the negatively sloped part of the compressor speed line of FIG. 1, can ensure stable compressor operation. Doing this, however, may result in a performance penalty since peak performance and efficiency often occur near the surge line.

If the surge line can be adjusted to include lesser flow rates, a number of operational advantages are possible. These operational advantages include, but are not limited to, providing added reliability since the likelihood of surge induced damage will be decreased, operating the compressor with lower power consumption by operating the compressor at or closer to its peak efficiency point, and providing compressor operation over a wider range of operating capacities and pressures.

Because of its importance, the control of compressor surge has been investigated in the past. For example, active suppression of centrifugal compressor surge has been demonstrated on a centrifugal compressor equipped with a servo-actuated plenum exit throttle controller. This technique teaches using closed-loop feedback control of the dynamic behavior of the compression system.

Additionally, U.S. Pat. No. 5,199,856 teaches a surge control system comprising coupling a centrifugal compressor system to a flexible plenum wall which is modeled as a mass-spring-damper system to respond to pressure perturbations in the plenum. The flexible plenum wall is described as a rigid piston which is sealed with a convoluted diaphragm.

The surge control systems described hereinabove generally require components and assemblies in addition to the standard components of turbomachinery compression systems. The present invention provides a passive surge control system which is made integral with standard centrifugal compressor components thereby eliminating the need for additional compressor components and assemblies.

SUMMARY OF THE INVENTION

In one aspect of the present invention, this is accomplished by providing an apparatus for achieving passive damping of flow disturbances in a centrifugal compressor to control centrifugal compressor surge. The apparatus includes a centrifugal compressor for compressing a low pressure fluid. The centrifugal compressor has an impeller, an inlet which communicates with an atmosphere and a discharge through which compressed air is supplied to a compressed air system. A fluid flow control is flow connected with the inlet for controlling the flow of a low pressure fluid to the compressor. A check valve is flow connected with the discharge for preventing high pressure fluid from back flowing to the compressor. A vane diffuser assembly fluidly communicates with the impeller. The check valve is connected to passive elements to form a spring-mass-damper system to dampen low amplitude flow disturbances of the compressible fluid.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
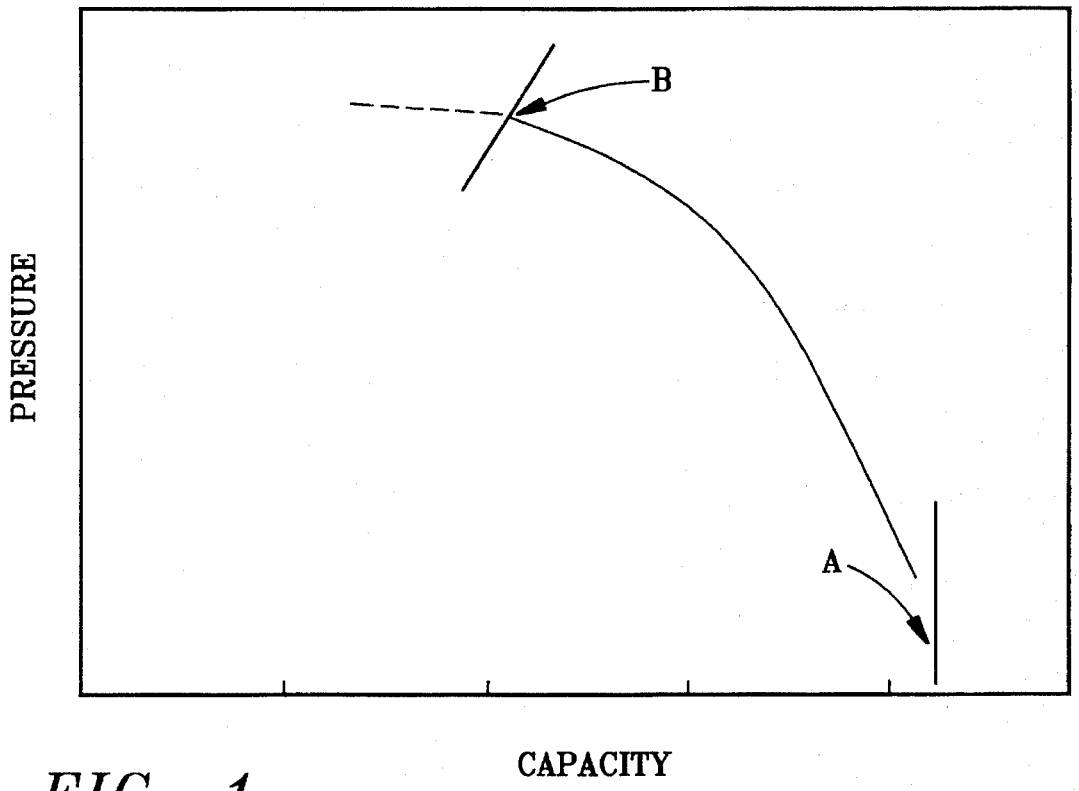
FIG. 1 is a graph of centrifugal compressor pressure versus centrifugal compressor capacity.

Centrifugal compressors have capacity limits bounded by choke at a high compressed fluid flow limit and surge at a low compressed fluid flow limit. In FIG. 1, a compressor performance diagram is provided to illustrate the manner in which centrifugal compressor discharge pressure varies as a function of flow rate at a discharge outlet of a typical centrifugal compressor. The choke limit is indicated at Position A, and the surge limit is indicated at Position B. The apparatus of the present invention operates to shift the surge line into the dashed line portion of the speed line of the compressor performance diagram to include lesser compressor flow rates which provide the compressor operational benefits described hereinabove.

Figures 2, 10:
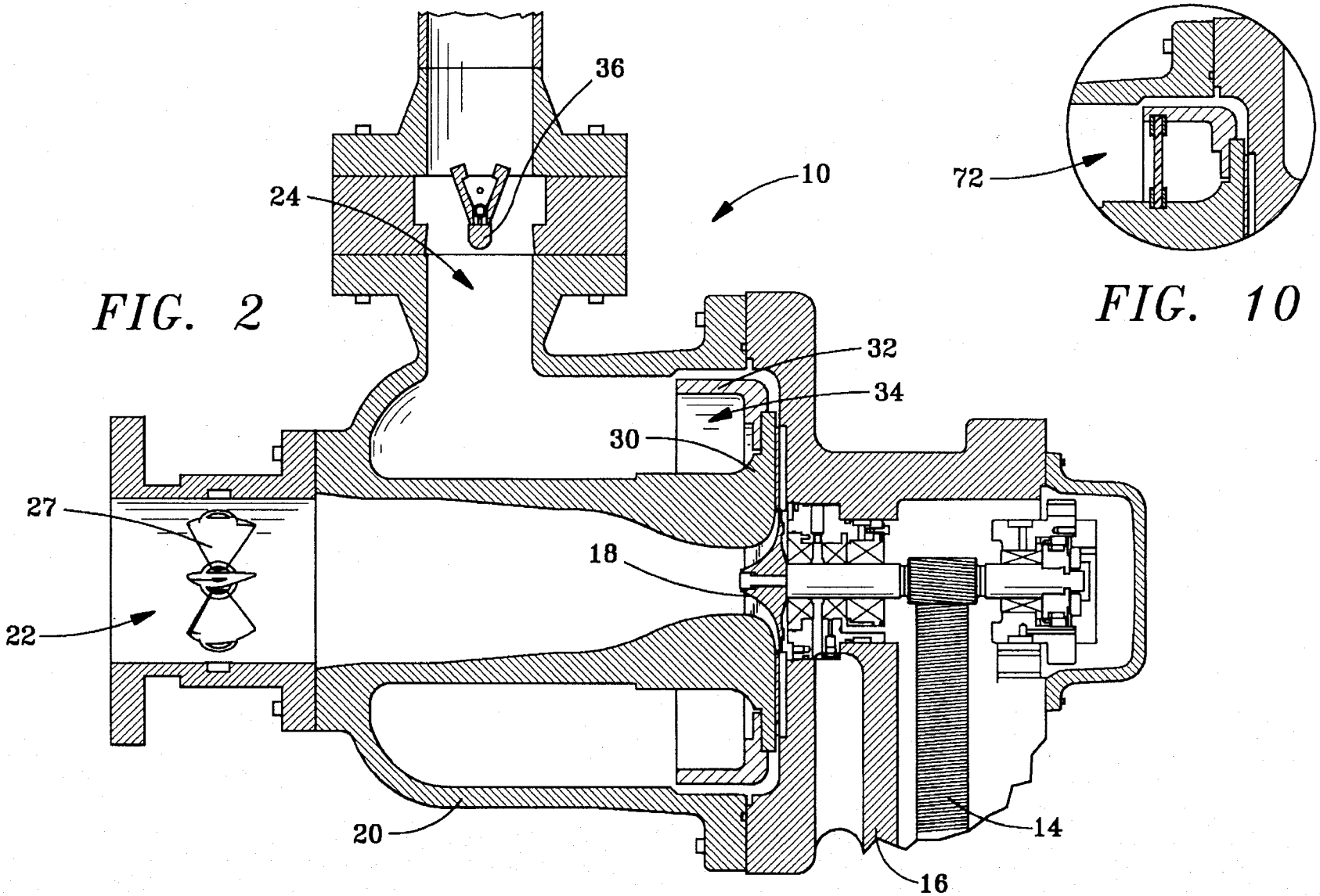
FIG. 2 is a partial illustration of a centrifugal compressor incorporating the apparatus of the present invention.
FIG. 10 is a partial, sectional view of a diaphragm assembly for achieving passive damping of flow disturbances in a centrifugal compressor to control compressor surge.

Referring now to the remaining drawings, wherein similar reference characters designate corresponding parts throughout the several views, FIG. 2 is a partial illustration of a centrifugal compressor 10 including the apparatus according to the present invention.

The centrifugal compressor 10 compresses a low pressure fluid, such as air, to a predetermined pressure, and supplies the compressed air to a compressed air system (not shown) for use by an object of interest (not shown). The compressor 10 may be of a single stage or a multi-stage design. A prime mover (not shown) is engageable with a gear drive system 14 which is mounted for operation in a suitably dimensioned housing 16. An impeller assembly 18 is engagable with the gear drive system which drives the impeller assembly during compressor operation.

Figure 3:
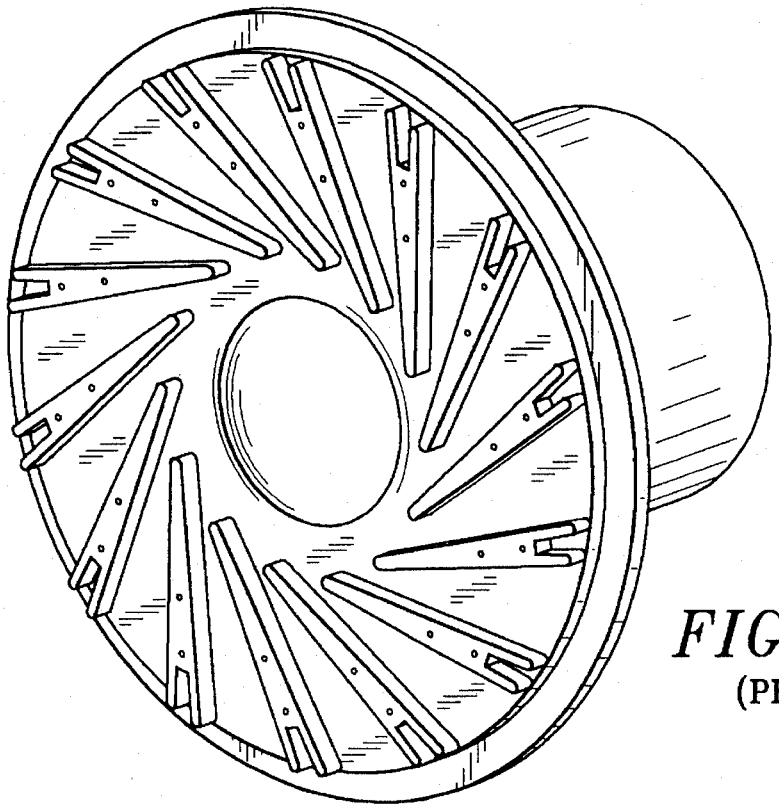
FIG. 3 (PRIOR ART)
FIG. 3 is a perspective view of a prior art matched-vane diffuser assembly, or vane diffuser assembly.

A compressor housing section 20 houses the impeller assembly 18, and includes an inlet duct 22 and a discharge duct 24. Generally, the inlet duct 22 is flow connected with a fluid flow control apparatus 27 which controls the flow of a low pressure fluid, such as atmospheric air or a gas, to the impeller, and with a vane diffuser assembly 30 which fluidly communicates with the impeller. A prior art matched-vane diffuser assembly is illustrated in FIG. 3 which has been modified in accordance with the teachings of the present invention as described hereinafter. It is anticipated that the fluid flow control apparatus 27 may include an inlet guide vane assembly, as illustrated in FIG. 2, or an inlet valve assembly, such as a butterfly valve, for example.

Referring to FIG. 2, made integral with the matched-vane diffuser assembly 30 is annular structure 32, which, together with the vane diffuser assembly 30, forms an annular shaped plenum 34 which communicates with the fluid having a high static pressure state. A check valve assembly 36 is flow connected with the discharge duct 24 to prevent high pressure fluid from back flowing to the compressor 10.

In accordance with the present invention, several methods are disclosed for damping low amplitude flow disturbances of the compressible fluid within the compressor 10. Each method involves integrating with typical centrifugal components, such as the vane diffuser assembly 30, the check valve assembly 36 and the fluid flow control apparatus 27, an apparatus for dissipating energy. More particularly, these centrifugal compressor components are modified to model a spring-mass-damper system which operates to damp the low amplitude flow disturbances of the compressible fluid. These modified compressor components are illustrated in FIGS. 4–9, and are described in further detail hereinafter. Those skilled in the art will appreciate that the spring and damper elements illustrated in FIGS. 4–9 need not be separate, and that the illustrated arrangements are merely exemplary.

The vane diffuser assembly 30 differs from prior art vane diffusers, such as that illustrated in FIG. 3, in that the vane diffuser assembly 30 is modified to include at least one vane which is connected to passive elements to form a spring-mass-damper system to dampen any low amplitude flow disturbances of the compressible fluid at the vane diffuser assembly.

Figure 4:
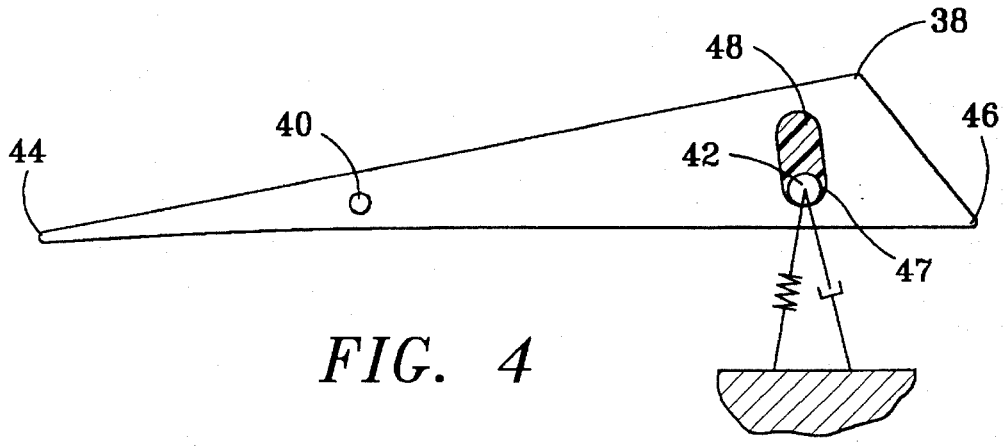
FIG. 4 is a schematic illustration of a radial diffuser vane for modifying the matched-vane diffuser assembly of FIG. 3.

FIG. 4 schematically illustrates a radial vane 38 which is mounted by first and second mounting pins 40 and 42 to a vane diffuser assembly, such as that illustrated in FIG. 3. Accordingly, the vane diffuser assembly is modified to form a spring-mass-damper system in accordance with the present invention. The radial vane 38 includes opposed first and second ends 44 and 46, respectively. The second pin 42 is located in a slot 47 having an elastomeric material 48 disposed therein. It is anticipated that the elastomeric material may be a natural or synthetic material. During compressor operation, the radial vane 38 of FIG. 4 is moveable about pin 40, and the damping is accomplished by action of the pin 42 in combination with the elastomeric material 48.

Figure 5:
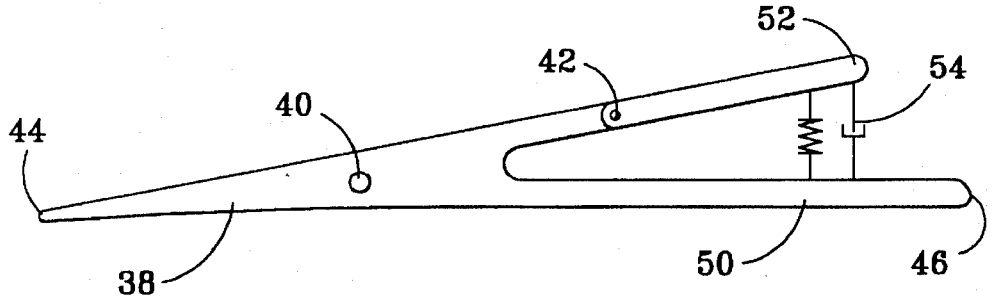
FIG. 5 is a schematic illustration of a radial diffuser vane for modifying the matched-vane diffuser assembly of FIG. 3.

FIG. 5 schematically illustrates a radial vane 38 which is mounted by first and second mounting pins 40 and 42 to a vane diffuser assembly, such as that illustrated in FIG. 3. Accordingly, the vane diffuser assembly is modified to form a spring-mass-damper system in accordance with the present invention. The radial vane 38 of FIG. 5 generally includes opposed first and second ends, 44 and 46, respectively. The second end 46 defines at least two leg members 50 and 52. Leg member 52 is movably connected to the vane. For example, leg member 52 may be hinged to the radial vane 38 at the mounting pin 42. The leg member 52 is connected to passive elements 54 to form a spring-mass-damper system.

Figure 6:
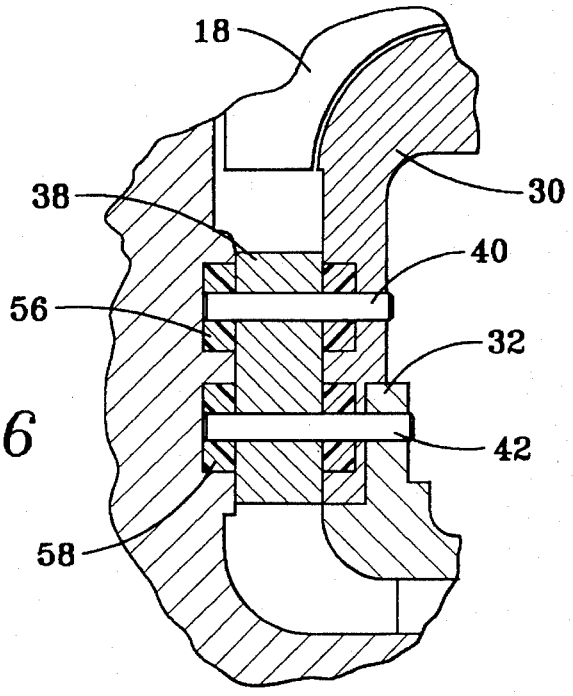
FIG. 6 is a partial, sectional view of a radial diffuser vane which is mounted to a matched-vane diffuser assembly.

FIG. 6 schematically illustrates a radial vane 38 which is mounted by first and second mounting pins 40 and 42 to a vane diffuser assembly, such as that illustrated in FIG. 3. Accordingly, the vane diffuser assembly is modified to form a spring-mass-damper system in accordance with the present invention. The first and second mounting pins are engageable with first and second pairs of elastomeric grommets, 56 and 58, respectively. The elastomeric grommets of FIG. 6 provide damping for the radial vane 38.

It is contemplated that any one or all of the radial vanes 38 of the vane diffuser assembly 30 may be mounted as illustrated in FIGS. 4, 5, and 6. Additionally, it is contemplated that the axial vanes of the vane diffuser assembly 30 may be mounted in accordance with the teachings described hereinabove. It should be understood that any number of alternate embodiments may be employed to mount a vane of a vane diffuser assembly to dampen low amplitude flow disturbances, and that the illustrated embodiments are merely exemplary.

Figure 7:
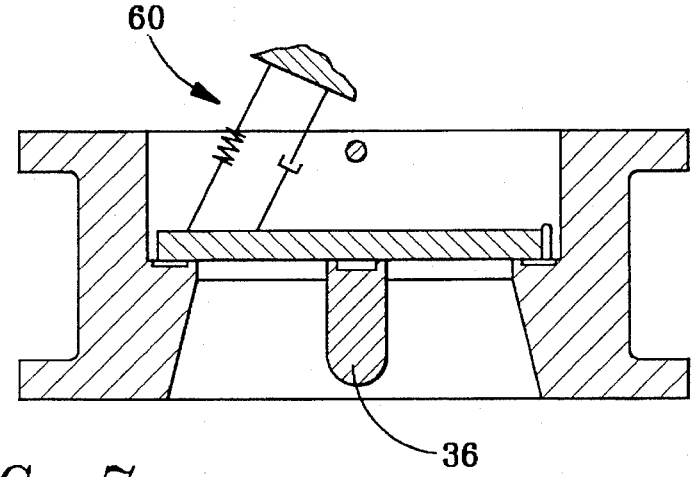
FIG. 7 is a schematic illustration of a check valve according to the present invention for the centrifugal compressor of FIG. 2.

FIG. 7 schematically illustrates the present invention wherein the check valve 36 is flow connected with the compressor discharge to prevent high pressure fluid from back flowing to the compressor. The check valve 36 is connected to passive elements 60 to form a spring-mass-damper system for damping low amplitude flow disturbances of the compressible fluid. By placing the passive elements 60 within the check valve construction, a spring-mass-damper system becomes an active part of the trapped volume of compressed fluid as seen by the compressor stage. When properly tuned, the passive elements 60 will favorably retard the onset of surge as it dampens the small flow disturbances that precede surge.

Figure 8:
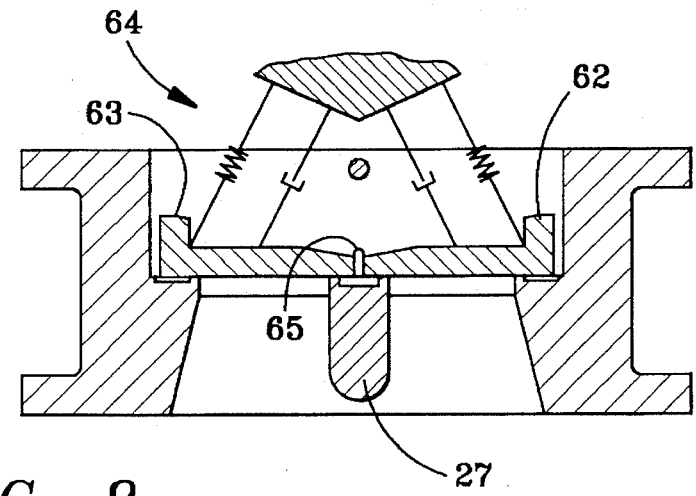
FIG. 8 is a schematic illustration of a butterfly valve for the centrifugal compressor of FIG. 2.
Figure 9:
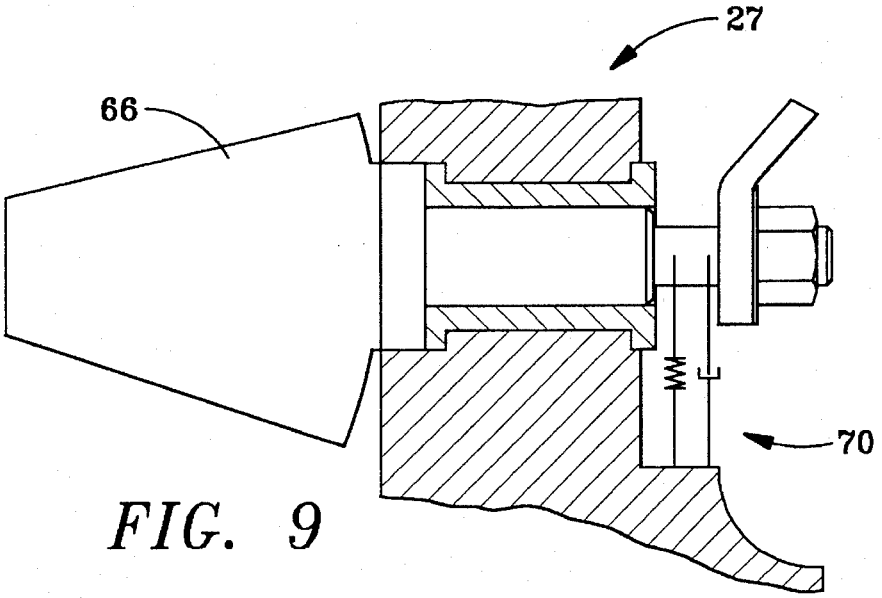
FIG. 9 is a partial, schematic illustration of an inlet guide vane assembly for the centrifugal compressor of FIG. 2.

FIG. 8 schematically illustrates a centrifugal compressor 10 wherein the fluid flow control apparatus 27, which is illustrated as a butterfly valve, includes valve plates 62 and 63 which are connected to passive elements 64 to form a spring-mass-damper system for damping low amplitude flow disturbances of the compressible fluid. The plates 62 and 63 are joined by hinge member 65. As shown in FIG. 8, the passive elements are directly connected to the first and second valve plates to form the spring-mass-damper system. Additionally, FIG. 9 schematically illustrates a centrifugal compressor 10 wherein the fluid flow control apparatus 27, which is illustrated as the inlet guide vane assembly includes at least one guide vane assembly 66 which is connected to passive elements 70 to form a spring-mass-damper system for damping low amplitude flow disturbances of the compressible fluid. By placing the passive elements 64 and 70 within the construction of the compressor fluid flow control assemblies, a spring-mass-damper system becomes an active part of these flow control assemblies to retard the onset of compressor surge by damping the small flow disturbances that precede surge.

In addition to the foregoing, it is anticipated that the onset of compressor surge can be retarded by damping the small flow disturbances that precede surge by action of a diaphragm assembly 72 integrally mounted within the annular shaped plenum 34, as illustrated in FIG. 10.

The various assemblies and methods disclosed in this specification involve integrating basic centrifugal compressor parts with fluid dynamic or structural dynamic mechanisms to dissipate energy. These dynamic mechanisms are modeled as spring-mass-damper systems which respond to pressure perturbations within the compressor. Those skilled in the art will appreciate that the passive elements 54, 60, 64 and 70, which are illustrated as spring and damper elements, need not be separate. These arrangements are merely exemplary. Also, the spring-mass-damper systems described herein must be properly "tuned" because a mistuned spring-mass-damper system can be destabilizing.

While this invention has been illustrated and described in accordance with a preferred embodiment, it is recognized that variations and changes may be made therein without departing from the invention as set forth in the following claims.

Having described the invention, what is claimed is:

1. An apparatus for achieving passive damping of flow disturbances in a centrifugal compressor to control centrifugal compressor surge, the apparatus comprising:

a centrifugal compressor for compressing a low pressure fluid, the centrifugal compressor having an impeller, an inlet which communicates with an atmosphere and a discharge through which compressed air is supplied to a compressed air system;

a fluid flow control connected with the inlet for controlling the flow of a low pressure fluid to the compressor;

a check valve connected with the discharge for preventing high pressure fluid from back flowing to the compressor the check valve having a first valve plate, a second valve plate and a hinge member connecting the first and second valve plates;

a vane diffuser assembly fluidly communicating with the impeller, the vane diffuser assembly forming an annular shaped plenum which communicates with a high static pressure fluid; and means for damping low amplitude flow disturbances of the compressible fluid, the damping means comprising the check valve first and second valve plates which are directly connected to passive elements to form a spring-mass-damper system to dampen low amplitude flow disturbances of the compressible fluid.

2. A compressor surge control apparatus for a compressible fluid comprising:

a centrifugal compressor for compressing a low pressure fluid, the centrifugal compressor having an impeller, an inlet which communicates with an atmosphere and a discharge through which compressed air is supplied to a compressed air system; and a check valve connected with the discharge for preventing high pressure fluid from back flowing to the compressor, the check valve having a first valve plate and a second valve plate, the valve plates being joined by a hinge member, the check valve first and second valve plates being directly connected to passive elements to form a spring-mass-damper system for damping low amplitude flow disturbances of the compressible fluid.

* * * * *